United States Patent [19]

Boyesen

[11] Patent Number: 4,696,263

[45] Date of Patent: Sep. 29, 1987

[54] REED VALVES FOR INTERNAL COMBUSTION ENGINES

[75] Inventor: Eyvind Boyesen, Kempton, Pa.

[73] Assignee: Performance Industries, Inc., Kempton, Pa.

[21] Appl. No.: 911,485

[22] Filed: Sep. 25, 1986

Related U.S. Application Data

[63] Continuation-in-part of Ser. No. 754,243, Jul. 12, 1985, abandoned.

[51] Int. Cl.[4] ..... F02B 75/02

[52] U.S. Cl. ..... 123/65 V; 123/73 V; 137/855

[58] Field of Search ..... 123/65 V, 73 R, 73 A, 123/73 V; 137/843, 512.1, 855

[56] References Cited

U.S. PATENT DOCUMENTS

| | | | |
|---|---|---|---|
| 157,791 | 12/1874 | Cameron | 137/512.1 |
| 861,566 | 7/1907 | Wiki | 137/512.15 |
| 919,036 | 4/1909 | Langer | 137/512.1 |
| 939,549 | 11/1909 | Reineking | 137/856 |
| 1,614,124 | 8/1926 | Hansen | 137/512.15 |
| 2,689,552 | 9/1954 | Keikhaefer | 123/73 V |
| 3,107,659 | 10/1963 | Steinlein et al. | 123/73 V |
| 3,687,118 | 8/1972 | Nomura | 123/73 R |
| 3,983,900 | 10/1976 | Airhart | 137/855 |
| 4,082,295 | 4/1978 | Bainard | 123/73 V |
| 4,179,883 | 12/1979 | Nishiyama et al. | 137/856 |
| 4,228,770 | 10/1980 | Boyesen | 123/65 V |

FOREIGN PATENT DOCUMENTS

| | | | |
|---|---|---|---|
| 456430 | 6/1913 | France | 137/512.15 |

OTHER PUBLICATIONS

*Cycle,* Jan. 1985, "Reeds One-Way Valves", Kevin Cameron.

*Cycle Illustrated,* Oct. 1972, "Husqvarna Trans-AMA Reed Valve Prototype", Gore, G. J., pp. 12–17.

*Primary Examiner*—Craig R. Feinberg
*Assistant Examiner*—David A. Okonsky
*Attorney, Agent, or Firm*—Kenneth P. Synnestvedt

[57] ABSTRACT

Reed valves for internal combustion engines are disclosed, the reed valves having protective coating of synthetic rubber.

9 Claims, 4 Drawing Figures

REED VALVES FOR INTERNAL COMBUSTION ENGINES

CROSS REFERENCE

This application is a continuation-in-part of application Ser. No. 754,243, filed July 12, 1985 and now abandoned.

BACKGROUND AND STATEMENT OF OBJECTS

This invention relates to reed valves for use in internal combustion engines, and the invention is particularly concerned with reed valves formed of resin materials and having a coating for protecting the valves from deterioration by chemical attack and/or subjection to high temperatures. Although the reed valves of the present invention are useable in a wide variety of internal combustion engines, the valves of the present invention are particularly adapted for use in internal combustion engines operating on the two-cycle principle, especially such two-cycle engines where the engines incorporate a plurality of cylinders.

In various internal combustion engines, and particularly in multi-cylinder, two-cycle internal combustion engines, it has been noted that reed valves formed of resin materials are subjected to certain operating conditions having a tendency to deteriorate the resin material of which the reed valves are formed, especially in the marginal areas of the valve reeds where they overlie and contact the areas of the valve seat immediately surrounding the valve port. Although the tendency for deterioration may not be constantly present, there are times in the operation of an engine of the kind referred to where the tendency for deterioration becomes more pronounced. It is believed that a backfiring condition, which occurs particularly at the time of engine starting or before the normal steady state operation is established, represents a condition which accentuates the tendency for corrosive attack. In any event, it has been found that at some times in the operation of the engine, there are conditions under which certain gases tend to leak in reverse flow under the edges of the reed valves. It is possible this may occur even during normal closure of the valves and/or at times when the valve reeds are not completely closed. These conditions have been found to deteriorate the reed valve surfaces presented toward the valve seat surrounding the valve port.

It is a primary object of the present invention to provide reed valves adapted to resist deterioration even when used in engines having the deterioration tendency above referred to.

BRIEF DESCRIPTION OF THE DRAWINGS

How the foregoing objects and advantages are attained will be clear from the following description referring to the accompanying drawings, in which.

DETAILED DESCRIPTION OF THE DRAWINGS

Figure 1:
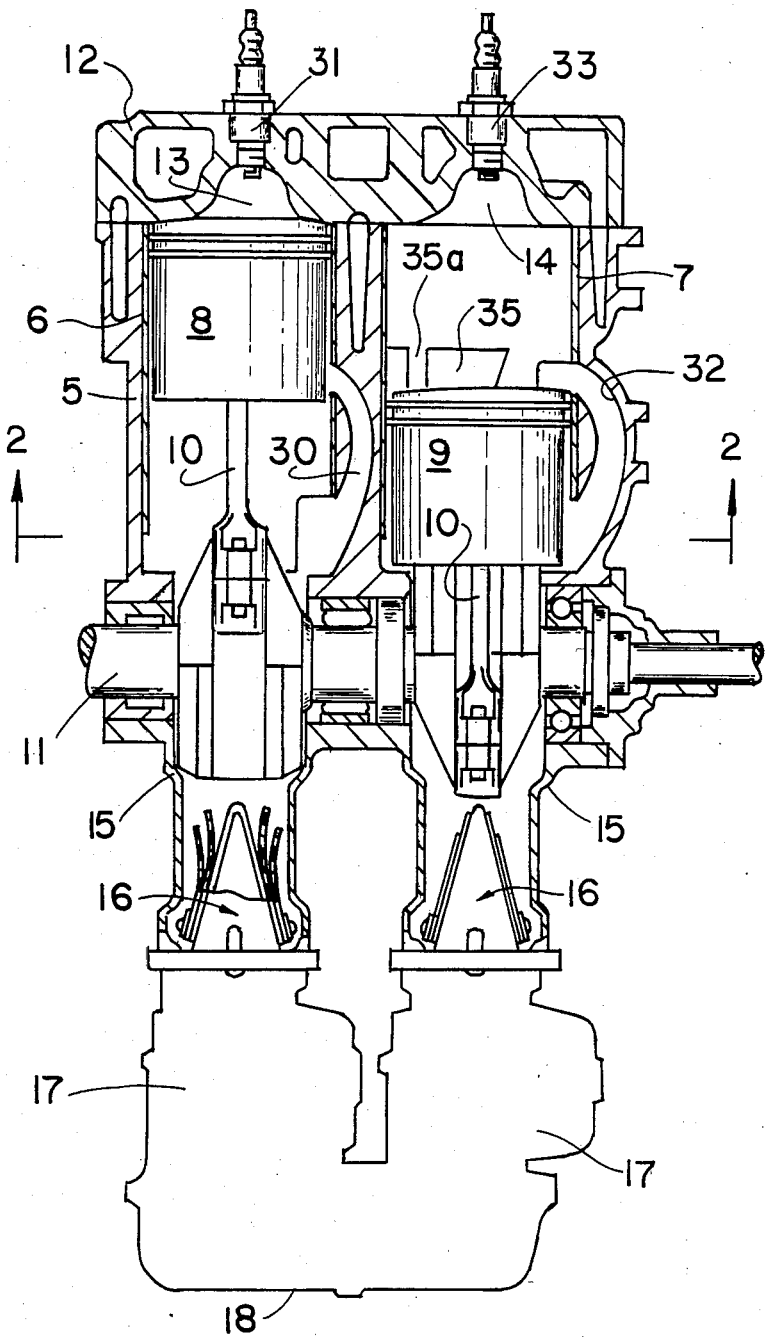
FIG. 1 is a sectional view of a two-cylinder, two-cycle engine of the kind above referred to and in which the intake system, including the reed valves, is arranged to separately deliver the fuel/air mixture into crankcases for the individual cylinders.
Figure 2:
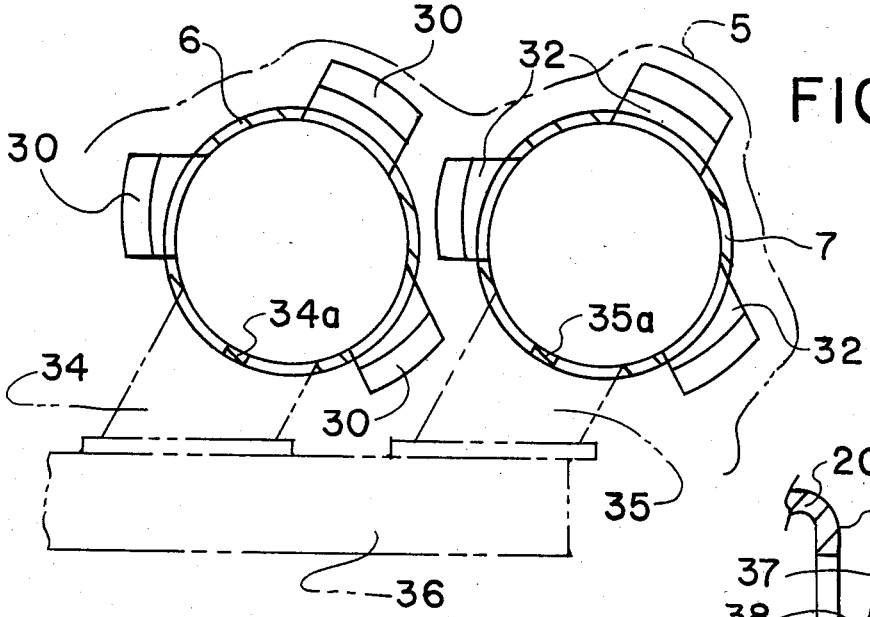
FIG. 2 is a somewhat diagrammatic transverse sectional view taken as indicated by the section line 2—2 on FIG. 1.

Referring first to FIGS. 1 and 2, an engine housing structure is indicated at 5, this structure having a pair of cylinders in side-by-side relation, defined by the cylinder liners 6 and 7. Pistons 8 and 9 are arranged to reciprocate in the cylinders 6 and 7, each piston having a connecting rod 10 associated with a crank on the crankshaft 11, this general arrangement of the major components of such an engine not being shown in detail herein but being well-known in this art. A cylinder head or cover 12 has separate spark ignition chambers 13 and 14 for the respective cylinders.

Each of the two cylinders is also provided with a separate crankcase 15, the two crankcases being isolated from each other as is common in multi-cylinder, two-cycle engines. As shown in FIG. 1, each crankcase is provided with an intake valve structure, indicated generally at 16, which serves to mount the reed valves for that cylinder and to introduce into the crankcase the desired fuel/air mixture as provided, for example, by carburetors housed within the enclosures indicated at 17. These carburetors or other fuel supply systems may, in turn, be supplied with the fuel from a common source provided within the casing 18. The details of these fuel supply carburetors and casing need not be considered herein as they are well-known in this art.

Figure 3:
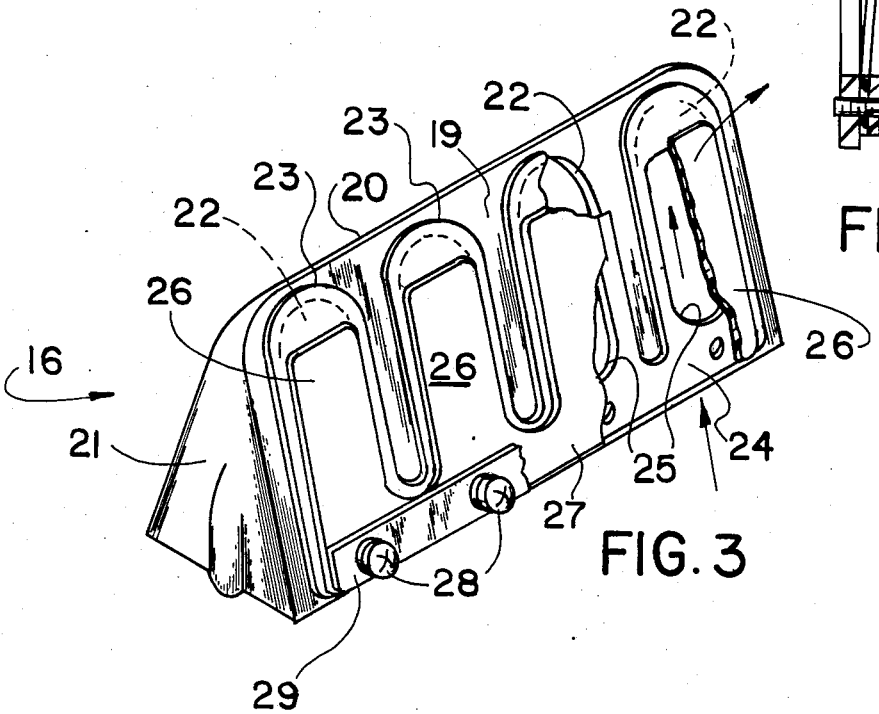
FIG. 3 is an enlarged perspective view of an assembly of reed valves associated with a reed valve cage adapted for use in the intake channel of a cylinder of the kind shown in FIGS. 1 and 2.

Referring to FIG. 3, one of the intake valve structures 16 is shown in greater detail, and from this view, it will be seen that this structure includes a wedge-shaped reed cage having two inclined side walls 19 joined along an apex 20 and having a pair of end walls 21. Each of the side walls 19 is provided with one or more, for instance, four valve ports 22. The valve ports at each side are provided with reed valves 23, the four reed valves shown in this embodiment being interconnected along the base ends of the valves by the marginal strip 24.

Each of the primary valve reeds 23 is provided with a port 25, and secondary valve reeds 26 overlie the ports 25 in the primary reeds. As with the primary reeds, the secondary reeds 26 are interconnected, as indicated at 27, along the lower edge thereof, the assembly of primary and secondary reeds being secured to the body of the reed cage 16 by means of screws 28 and a strip 29 overlying the lower edges of the inclined side walls 19 of the reed cage.

Each of the crankcases 15 is independently associated with one of the cylinders, and during upward movement of the piston in that cylinder, for instance, the piston 8 in the cylinder 6, the pressure reduction below the piston results in intake flow of the fuel/air mixture from the associated reed valve assembly, thereby delivering a charge of the fuel into the crankcase space below the piston. When the piston moves downwardly, the charge of fuel in the crankcase is compressed and the compression continues until the upper edge of the piston uncovers the ports of the transfer passages 30. Each transfer passage interconnects the crankcase space below the piston and the combustion chamber above the piston, and because of the compression of the fuel/air mixture in the crank chamber because of the downward stroke of the piston, the compressed fuel/air mixture will flow upwardly through the transfer passage and into the combustion chamber above the piston.

Upon the next upward stroke of the piston, the piston closes the transfer ports and compresses the charge of fuel in the combustion chamber above the piston, and in the region of the top dead center position of the piston, ignition occurs, as by the spark plug 31, thereby igniting the compressed charge in the combustion chamber and driving the piston downwardly with resultant compression of the next succeeding charge in the crankcase.

This type of operation is well-known in two-cycle engines, and in a multi-cylinder, two-cycle engine as shown in the drawings, similar transfer passages 32 and spark plug 33 are provided for the other cylinder. In a two-cylinder, two-cycle engine of the kind illustrated and described, the two pistons are connected with the crankshaft 11 at 180° from each other, so that the various phases of the operation of the two cylinders occurs in the 180° relationship, as is well-known.

As best seen in FIG. 2, each of the cylinders 6 and 7 is preferably provided with several transfer passages 30 for cylinder 6, and 32 for cylinder 7. In addition, as will be seen from FIG. 2, each cylinder is provided with an exhaust port and passage, indicated at 34 for cylinder 6, and at 35 for cylinder 7. In the engine shown, the two exhaust passages deliver the exhaust products to a common exhaust duct 36, and this exhaust duct customarily delivers the exhaust products through a muffler or discharge device. Because the exhaust ports (34 or 35) extend through a substantial part of the circumference of the cylinder, it is desirable to provide a bridge in the cylinder liners, as shown at 34*a* and 35*a* in FIGS. 1 and 2, in order to provide adequate lateral support for the pistons.

The discharge of the exhaust products from the combustion chamber occurs under the influence of the increased pressure incident to combustion occurring in the combustion chamber, and a substantial portion of the exhaust products exits through the exhaust passage (34 or 35) as soon as the piston opens the port in the cylinder wall leading to the exhaust passage. As will be evident from FIG. 1, toward the bottom of the piston stroke at the time when the transfer ports are opened by the piston, the inflow of the compressed fuel from the crankcase will assist in removing or "scavenging" the exhaust products from the combustion chamber into the exhaust passages.

Before considering certain of the important features of the reed valves provided by the present invention, it is here pointed out that in various internal combustion engines, and particularly in a multi-cylinder, two-cycle engine of the kind shown in the drawings, certain operating conditions tend to cause leakage of gases under the edges of the reed valves and may even result in contact of gases with valve reeds at times when those reeds are somewhat displaced from the valve seats provided on the reed cage 16. It is believed that this type of condition occurs primarily at engine starting times, especially when the engine is cold; and in many engines, this type of condition is referred to as backfiring.

Although the exact conditions tending to induce the reverse leakage of gases under the edges of the reed valves may not be fully understood, it has, nevertheless, been found that certain operating conditions in an engine of the kind herein disclosed result in contact of gases, believed to be oombustion products, with the underlying surfaces of the valve reeds, especially at the edges overlying the marginal edges of the valve seat surrounding the valve port. This tends to deteriorate or scar the material of which the reed valves are formed resulting in pitting or deterioration of the surface of the reed valve, with consequent impairment of the effective operation of the valve. If this condition persists over a period of time, the reed valves may become seriously damaged, with impairment in the effectiveness of the action of the reed valves and also danger of ultimate destruction of the valve reed.

Having the foregoing in mind, the present invention provides for the use of valve reeds which, in typical cases, may be formed of glass fiber reinforced epoxy resins, or similar resins, and those valve reeds are then supplied with a protective covering on the underside, the covering preferably being formed of a material having rubber-like characteristics.

Figure 4:
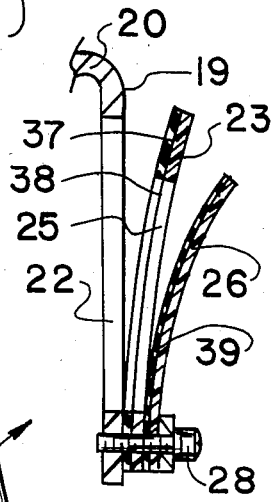
FIG. 4 is an enlarged fragmentary view showing the detail of coated valve reeds provided according to the present invention.

As seen in FIG. 4, each of the reeds 23 is provided with a layer of rubber, for instance, buna-N rubber. In a typical case, this rubber is provided as a preformed film or layer, as indicated at 37, the layer being bonded to the epoxy resin valve reed by an adhesive, as indicated at 38. In connection with this arrangement of the rubber coating, it is to be noted that while the tendency to deteriorate the material of the valve reeds tends to occur at the points of contact between the valve reed and the metal surrounding the valve port in the reed cage, I have found that the elimination of the deterioration is not effective by applying a rubber coating to the reed cage around the valve port, but is only effective by applying the rubber to the surface of the valve reed which comes into contact with the metal of the reed cage.

In some installations, adequate protection of the valve reeds may be effected by providing the rubber coating only on the primary valve reeds, without any coating being applied to the secondary reeds. However, for certain purposes, it is also found to be desirable to apply a rubber coating to the secondary reeds. In a typical case, this coating may be established by applying a coating of a synthetic rubber material having adhesive properties, such layer being shown at 39. This material may be applied in liquid form and dried or cured in place.

Attention is now directed to the material from which the valve reeds, such as indicated at 23 and 26, are formed. Such valve reeds, for many combustion engine purposes, are formed of resin material, the epoxy type of resins having glass fiber reinforcement being particularly effective for this purpose in two-cycle engines. The resin material employed for the main structure of the valve reeds preferably has a relatively high modulus of elasticity. In a typical case, such a glass fiber reinforced epoxy resin may be heat resistant up to about 350° F. and have a modulus of elasticity of the order of from 2,000,000 to 2,700,000. Some resins useable for the base material of the valve reeds, including not only epoxy resins but also melamine, silicone and phenolic resins, preferably glass fiber reinforced, may have a modulus of elasticity ranging upward from about 1,000,000 to the range above referred to for the preferred epoxy resin materials. Some of such resins have heat resistance from about 200° F. up to about that of the epoxy resin materials.

In typical installations, the primary reeds are somewhat thicker than the secondary reeds, and in a typical installation, the ports in the primary reeds are smaller than the ports in the walls of the reed valve cage.

As above explained, the epoxy resins have a tendency to become pitted or deteriorate when employed for valve reeds used in certain engines, such as the two-cylinder, two-cycle engine described above and illustrated in the drawings; and it is a principal objective of the present invention to provide for the protection of reeds made of such epoxy or similar resins as against deterioration in service. For this purpose, the invention provides for the application of a protective coating to the base resin material of the valve reeds, and this may be accomplished in various ways and with various materials, as further explained herebelow.

First, it is pointed out that it is an important objective of the present invention to provide such a protective coating on the underside of the valve reeds which come in contact with the valve structure surrounding the principal valve ports. It has been found that the tendency to deteriorate is concentrated in the region of engagement of the edge portions of the valve reed with the surface of the valve structure immediately surrounding the valve port. In a preferred embodiment, the protective coating is formed of a rubber material, desirably a synthetic rubber having high resistance to chemical attack and also having good heat and wear resistance, one preferred material for this purpose being buna-N rubber, i.e., a synthetic rubber formed as a butadiene styrene copolymer. In a preferred embodiment employing the buna-N rubber, the rubber is desirably preformed in sheet form and then adhesively bonded to the surface of the epoxy or other base resin material by means of an intervening adhesive coating.

For the rubber coating, it is also possible to employ certain other synthetic rubber-like resin materials, including urethane rubber, silicone rubber, neoprene rubber and fluoroelastomers such as materials available under the name Viton.

Where a preformed sheet or film is employed, an adhesive or bonding agent may be used between the preformed sheet or film and the surface of the valve reed, in order to adhesively fasten the preformed sheet or film to the surface of the epoxy or other base material of the valve reed. The adhesive or bonding agent may be applied as a coating layer, being dried or cured to provide the desired bonding.

Various of these materials may also be applied to the primary reeds as coatings, which are dried or cured in place, and this may be done either with or without a separate bonding or adhesive agent intervening, depending upon the characteristics of the materials.

As above mentioned, it is also contemplated that the secondary valve reeds, such as indicated at 26, may be provided with a protective coating of a synthetic rubber-type material, for instance, materials of the kind referred to above, and if the secondary reeds are coated, the coating is applied only to the undersurface, i.e., the surface which overlies the surface of the primary reed surrounding the valve port in the primary reed, such port being indicated at 25 in FIG. 3. The use of rubber coated secondary valve reeds may not always be needed, even where the coating of the primary reeds is of importance in order to prevent deterioration and damage to the resin material used in the formation of the reeds.

It has been found that the undersurface of the primary reeds are the most likely surfaces to be damaged in the operation of the engine, particularly because of subjection to heat and contact with backfiring gases. The primary valve reeds have a greater tendency to be damaged than do the secondary valve reeds, apparently because the primary reeds have more extended surface area in contact with the areas surrounding the valve port. In addition, the primary reeds, being larger and thicker than the secondary reeds, are more subject to irregularities or inaccuracies in seating than the secondary reeds. It is, therefore, of special importance to provide the rubber coating on the undersurface of the primary reeds, and this is important not only from the standpoint of providing protection for the basic epoxy resin material of the primary reeds but is also highly desirable from the standpoint of providing a cushioning action upon closure of the primary reeds.

The resilience or cushioning action of the rubber not only provides a tight closure seal but also eliminates a source of vibrations which tend to contribute to the deterioration of the valve reeds. While the application of a rubber coating to the surface of the valve body surrounding the port might provide a cushion for the action of the valve, the coating of the valve body itself will not serve all of the purposes contemplated according to the present invention, particularly the tendency for the surface of the valve reed to become pitted or deteriorated because of elevation in temperature and contact with backfiring gases. By applying a rubber coating to the valve reed itself, both purposes are served, i.e., the valve reed is protected and the vibration is diminished.

The application of the rubber coating improves the sealing of the valve reed against the surface around the valve port, and this reduces leakage under the valve reed when the valve is closed. The reduction of leakage diminishes tendency for the surface of the valve to become pitted.

For the purposes above described, it is contemplated to employ a layer of rubber material substantially thinner than the thickness of the valve reed on which the rubber layer is adhesively applied. For example, with valve reeds of a thickness of from about 0.017" to 0.030", which is customary for primary reeds such as indicated at 23 in FIG. 4, the thickness of the layer of rubber material, such as indicated at 37 in FIG. 4, is preferably from about 0.002" to 0.014". For secondary reeds, such as indicated at 26 in FIG. 4, the thickness of the reed itself may be of the order of 0.010" to 0.020", and the thickness of the rubber layer may be of the order of 0.002" to 0.005".

Actually, the layer of rubber material may, in many instances, comprise no more than about 0.002", such as a coating layer applied by a coating process in which the rubber material is carried in solution in a solvent which will evaporate upon application. Various rubber materials have sufficient adhesive characteristics in themselves so that, in many instances, it would not be necessary to provide a separate layer of adhesive between the rubber layer and the resin layer of the reed itself. In some instances, it may, however, be desirable to introduce a thin adhesive coating between the two components of the reed.

The employment of the rubber layer, which is thinner than the resin layer itself, is of importance in assuring maintenance of the desirable vibration frequency of the reed itself, particularly at high engine operating speeds.

In connection with the synthetic rubber compounds useable in accordance with the present invention, it is noted that compounds of this type, for instance, buna-N rubber, have temperature resistance of the order of 225° F. to 250° F. Synthetic rubbers having somewhat lower or higher temperature resistance are also useable, for instance, rubbers having temperature resistance from about 200° F. up to 400° or 500° F. It will be noted that these temperature values may be either below or above the temperature resistance of the resin material of which the body of the reeds is formed, epoxy resins being typical and having a temperature resistance of the order of 350° F. The use of the rubber coating on the underside of the valve reed is effective in preventing deterioration or pitting of the reed, even where the temperature resistance of the rubber is lower than that of the epoxy resin used for the body of the valve reed. This improvement results apparently because the rubber compound provides a more precise and effective seal against the valve seat and thus diminishes the tendency for leakage to occur under the edges of the reed.

It will be understood that the rubber coated reeds of the present invention may also be employed where the reed valve arrangement does not include both primary and secondary reeds, but only a single reed over each valve port.

I claim:

1. A two-cycle engine comprising a cylinder, a piston working in the cylinder, the engine having a compression chamber below the piston, a fuel intake system including a ported valve seat for delivering fuel into the compression chamber, the cylinder having an exhaust port and a transfer passage for delivering compressed fuel from the compression chamber to the space above the piston, and a reed valve overlying the port in the valve seat and adapted to flex away from the ported seat during the upward stroke of the piston, the reed valve being of multiple layer construction with an outlet layer formed of relatively rigid resin material and an inner layer presented inwardly for contact with the valve seat and formed of relatively flexible temperature-resistant synthetic rubber material, the rubber layer being thinner than the resin layer and the resin and rubber layers being adhesively bonded to each other.

2. A reed valve adapted to overlie a ported fuel intake valve seat, the reed valve being of multiple layer construction and comprising a layer of buna-N rubber adapted to contact the valve seat and an overlying layer of resin material, the layer of resin material being thicker than the rubber layer and the resin material being selected from the group consisting of glass reinforced epoxy, phenolic, melamine and silicone resin materials, said layers being adhesively bonded to each other.

3. A reed valve adapted to overlie a ported fuel intake valve seat, the reed valve comprising a layer of glass reinforced epoxy resin material and a layer of rubber material selected from the group consisting of buna-N rubber, urethane rubber, silicone rubber and neoprene rubber, the layer of a glass reinforced resin material being at least two times the thickness of the rubber layer, and said layers being adhesively bonded to each other, with the rubber layer presented toward the valve seat and with the layer of resin material presented outwardly away from the valve seat.

4. A reed valve adapted to overlie a ported fuel intake valve seat in a flow passage and adapted to open or close the valve port according to the direction of flow in the flow passage, the reed valve being of multiple layer construction and comprising a layer of rubber material adapted to contact the valve seat and an overlying layer of resin material, the rubber layer being resilient and being thinner than and having greater yieldability than the resin layer and the resin layer being thicker than and having greater stiffness than the rubber layer and providing for opening and closing of the valve port according to the direction of flow in the flow passage.

5. A reed valve as defined in claim 4 in which the rubber layer comprises a preformed film of buna-N rubber and in which said preformed film is bonded to the resin layer by an intervening layer of adhesive material.

6. A reed valve as defined in claim 4 in which the rubber layer comprises silicone rubber adhesively bonded to the resin layer.

7. A two-cycle engine comprising a plurality of cylinders, a piston working in each cylinder, the engine having a compression chamber below each piston, a fuel intake system for each cylinder including a ported valve seat for delivering fuel into the compression chamber, the engine having an exhaust duct and each cylinder having an exhaust port communicating with said duct, and a transfer passage for each cylinder for delivering compressed fuel from its compression chamber to the space above the piston, and a reed valve overlying the port in the valve seat for each cylinder and adapted to flex away from the ported seat during the upward stroke of the piston in that cylnder, each reed valve being of multiple layer construction with an outer layer formed of relatively rigid resin material of thickness from about 0.017" to about 0.030" and an inner layer presented inwardly for contact with the valve seat and formed of a layer of relatively flexible rubber material of thickness of from about 0.002" to about 0.014", the resin and rubber layers being adhesively bonded to each other.

8. A multi-cylinder, two cycle engine comprising a plurality of cylinders, a piston working in each cylinder, each cylinder of the engine having a compression chamber below the piston, a fuel intake system including a ported valve seat for each cylinder for delivering fuel into its compression chamber, the cylinders having exhaust ports delivering exhaust gases to a common exhaust duct, and a transfer passage for each cylinder delivering compressed fuel from the compression chamber to the space above the piston, and for each cylinder a reed valve overlying the port in the valve seat and adapted to flex away from the ported seat during the upward stroke of the piston, the reed valve being of multiple layer construction with an outer layer formed of epoxy resin material and a thinner coating layer presented toward the valve seat and formed of buna-N rubber material, the epoxy and rubber layers being adhesively bonded to each other.

9. A reed valve assembly comprising a primary reed adapted to overlie a ported fuel intake valve seat, the primary reed having a port therethrough, and a secondary reed overlying the port in the primary reed, at least one of said reeds being of multiple layer construction and comprising a layer of relatively flexible rubber material and a layer of an epoxy resin material adhesively bonded to each other, the epoxy resin layer being thicker than the rubber layer, and the reed valve being positioned with the rubber layer at the side presented toward the underlying valve port.

* * * * *